US005131334A

United States Patent [19]

Monro

[11] Patent Number: 5,131,334

[45] Date of Patent: Jul. 21, 1992

[54] FLAME STABILIZER FOR SOLID FUEL BURNER

[76] Inventor: Richard J. Monro, 15 Nutmeg La., Wilton, Conn. 06897

[21] Appl. No.: 785,744

[22] Filed: Oct. 31, 1991

[51] Int. Cl.[5] ..... F23D 1/02

[52] U.S. Cl. ..... 110/264; 110/347; 431/183; 239/405

[58] Field of Search ..... 110/263, 264, 347; 431/182, 183, 185; 239/8, 399, 403, 405

[56] References Cited

U.S. PATENT DOCUMENTS 3,788,796 1/1974 Krippene et al. ..... 110/264 X
4,147,116 4/1979 Graybill .
4,249,470 2/1981 Vatsky .
4,270,895 6/1981 Vatsky .
4,333,405 6/1982 Michelfelder et al. .
4,457,241 7/1984 Itse et al. .
4,466,363 8/1984 Leikert et al. ..... 110/347
4,475,472 10/1984 Adrian et al. .
4,515,094 5/1985 Azuhata et al. .
4,532,873 8/1985 Rivers et al. .
4,545,307 10/1985 Morita et al. .
4,569,295 2/1986 Skoog .
4,614,159 9/1986 Sugiura et al. .
4,626,204 12/1986 St. Julian et al. .
4,681,532 7/1987 chung ..... 431/183
4,690,074 5/1986 Norton .
4,702,180 10/1987 Kiga .
4,768,446 9/1988 Wilkes et al. .
4,776,289 10/1988 Peter-Hoylyn .
4,790,743 12/1988 Leikert .
4,902,221 2/1990 Collins, Jr. et al. ..... 431/183
5,930,430 6/1990 Allen et al. .

*Primary Examiner*—Edward G. Favors
*Attorney, Agent, or Firm*—St. Onge Steward Johnston & Reens

[57] ABSTRACT

A flame stabilizer for a burner of solid fuel, such as pulverized coal or sander wood dust, is described whereby the swirl number is varied radially to enhance swirl inducement towards the periphery of the flame stabilizer while more axial flow occurs near the central conduit through which fuel is supplied. The amount of swirl and the amount of combustion air being selected so as to provide an integrated swirl number for the flame stabilizer in the range from about 0.6 to about 2.0. A pressure control ring is described with which the static pressure in the windbox is increased to a level where flame pulsations attributable to low static pressure in the windbox are reduced while the vortex is maintained. An enhanced axial combustion air flow around the discharge end of the fuel supply conduit is described to modify the position of the adverse pressure gradient boundary in a downstream direction.

20 Claims, 2 Drawing Sheets

FLAME STABILIZER FOR SOLID FUEL BURNER

FIELD OF THE INVENTION

This invention relates to solid fuel burners generally and more specifically to coal burners for use in utility boilers.

BACKGROUND OF THE INVENTION

Coal burners with swirl-inducing devices are well known in the art. For example, in U.S. Pat. Nos. 4,249,470 and 4,270,895 to Vatsky, a coal burner is shown and described wherein a mixture of coal powder with steam and/or air is delivered through two concentrically-arranged tubes to a discharge end. A swirler is located at this end and surrounds the tubes to induce swirling motion to secondary combustion air that is delivered through an annular passageway around the outer coal-delivering tube. U.S. Pat. No. 4,690,074 teaches a coal burner wherein the central fuel feed tube is surrounded by a swirling air stream. Another axially-directed air stream surrounds the swirling air stream. The volumes of these latter streams are stated as controllable. U.S. Pat. No. 4,790,743 teaches another coal burner using a swirler that is adjustable. In U.S. Pat. No. 4,569,295 primary air surrounding the fuel supply tube is set in rotation by a swirler formed of guide blades.

Swirl-generating devices are also known to be used in connection with gas burners. The swirlers typically employ vanes in the path of the gaseous fuel to produce a vortex to stabilize the flame position. The vanes are shaped so as to provide less swirl inducement towards the center or roots of the vanes and greater swirl inducement radially outward from the vane roots. As a result, there is more axial fuel flow near the center. However, the gas feed either is located in a small feed tube in the center or spread peripherally around the swirler. The vortex generated by the swirler typically extends to the center axis of the gas burner.

Swirling is controlled with the design or shape of the vanes. A swirl number is used to define critical flow characteristics of a burner. The swirl number is a ratio that defines how much of the combustion air going through a burner is rotating versus how much of the combustion air exiting a burner is in an axial flow condition. Mathematically, swirl number S is defined by the equation:

$$S = \frac{1}{r_{tip}} \cdot \frac{\int_{r_{hub}}^{r_{tip}} rV_t(\rho V_x 2\pi r)dr}{\int_{r_{hub}}^{r_{tip}} V_x(\rho V_x 2\pi r)dr}$$

The numerator represents the product of the radius R and the tangential momentum of the combustion air. The denominator represents the axial momentum of the air and R, is the burner throat radius which varies for the integral from the minimum radius $R_{hub}$ to the outer periphery $R_{tip}$. $V_x$ is the axial velocity; $V_t$, the tanential velocity and $\rho$ is the density of the air.

For burners, an important swirl number is 0.6. Swirlers with combustion airflows having swirl numbers less than 0.6 are unstable and exhibit poor fuel/air mixing. An analogy would be the vortex generated when water begins to flow out of a sink. The water begins to rotate and while the water is smooth, but clearly rotating, no depressions form in the surface. Water in this condition has a swirl number less than 0.6. In burner terms, no stabilizing internal recirculation vortices exist.

However, as the water picks up rotational momentum, it begins to develop a depression in the surface. At this point, it crosses the critical boundary of swirl number 0.6, creating an internal recirculating ring vortex. In a burner and its combustion process, the vortex stabilizes the flame in front of the burner.

As the water continues to rotate faster and faster, the depression extends deeper in the water. Eventually, the depression reaches down into the drain, aspirating air along with the water. The swirl number in this last condition is significantly greater than 0.6. While high swirl number combustion is very stable, burner damage can and usually does occur because high temperature furnace gases are aspirated into the burner.

FIG. 1 illustrates the result of so-called burn-back problems frequently encountered with conventional burners having swirl numbers. In FIG. 1, an excessively-swirled burner 8 is shown having fuel supplied through a fuel feed tube 10 to a discharge end 12 located in the throat 14 of the boiler wall 16. A swirler 18 is located in the vicinity of the discharge end 12 and surrounds it in the path of secondary air 20. As a result of the excessive swirl, a rotating hollow cone 22, formed by the combustion air and fuel flowing out of the burner, is resident in the burner. Hot furnace gases move upstream toward the burner along the burner centerline as illustrated by arrows 23.

Eventually, the adverse static pressure of furnace gases moving upstream from the furnace equals the static pressure of the combustion air and fuel flowing out from the burner. The boundary region 24 where this occurs is known as the adverse pressure gradient boundary and represents the boundary at which the furnace gases reverse direction and flow back towards the furnace 26. This reversed flow pattern results in an internal recirculating ring vortex 28 that stabilizes flame fronts. Air, fuel, and high temperature gases are entrained in the ring vortex 28. This then forms a stable ignition zone which remains fixed in position regardless of load as long as the swirl number does not change for the burner.

Single-zone and multi-zoned pulverized coal burners frequently encounter high swirl conditions attributable to swirl design air stream flow variations and under various loading. When excessive swirling occurs the adverse pressure gradient boundary 24 moves upstream as shown in FIG. 1 penetrating burner 8.

Since temperatures above 2500° exist in the flow regime on the furnace side of the adverse pressure gradient boundary 24, burner components which find themselves in this regime experience severe overheating, mechanical distortion, and thermal destruction. Also, fuel entrained in the furnace gases centrifuge out of the flue gas stream at the apex 32 of the adverse pressure gradient boundary 24. The burning fuel deposits in the burner 8 or the windbox 34, accelerating thermal damage. Severe burner destruction problems can occur.

It is, therefore an object of the invention to provide a method for stabilizing a solid fuel burner flame and a swirl flame stabilized solid fuel burner which avoids burn-back problems yet provides a well-stabilized flame throughout burner load variations. It is a further object of the invention to provide a flame stabilizer with which improved solid fuel burner performance can be obtained without flame instability, avoidance of windbox fires, and other burn-back problems. It is still further an object of the invention to provide such flame stabilizer whereby inadequate windbox-to-furnace differential pressure, furnace pulsations, and burner warping can be avoided.

SUMMARY OF THE INVENTION

The problems associated with these conventional swirl-type pulverized coal burners are avoided by the use of a flame stabilizer in accordance with the invention. The flame stabilizer can be provided as a retrofit to existing solid fuel burners or become an integral part of a burner.

A flame stabilizer in accordance with the invention has a vortex generator with vanes for swirl inducement. The vanes are shaped so as to radially vary the swirl inducement with more axial flow in the vicinity of the radially-inward region which thus has a relatively low swirl number and with enhanced swirl inducement towards the periphery of the flame stabilizer with a relatively high swirl number. The size of the vortex generator is also so selected so that it intercepts a sufficient amount of combustion air (20% to 40% of total combustion air) to yield an integrated swirl number for the entire flame stabilizer in the range from about 0.6 to about 2.0.

With a flame stabilizer in accordance with the invention, the overall swirl number for a coal burner can be made less than 1.0 throughout various load conditions and an ideal integrated swirl number, in the range from abut 0.7 to about 1.0, for the burner can be achieved so as to prevent burn-back problems while preserving a well-stabilized flame front.

In another aspect of a flame stabilizer in accordance with the invention, the static pressure on the upstream side of the vortex generator is maintained positive, i.e., higher, than the static pressure on the downstream side. This pressure differential need not be high, but should be sufficient to void the penetration of the adverse pressure gradient boundary into the windbox. One technique for achieving this positive pressure differential is the insertion of a small occlusion into the radial region where secondary combustion air passes between the exit throat of the windbox and the vortex generator. The occlusion can be achieved by reducing the size of the exit throat with an insert, but preferably by extending the radial periphery of the vortex generator. The occlusion reduces $NO_x$ by diverting and delaying entry of combustion air into the flame envelope, and thus, reducing the peak flame temperature.

As described herein for one flame stabilizer in accordance with the invention, the periphery of the vortex generator is radially extended with an apertured pressure control ring. The ring's radial width is selected to assure a positive static pressure differential sufficient to avoid upstream penetration of the adverse pressure gradient boundary. The pressure control ring is apertured with holes or slots so as to avoid excessive distortion of the flow characteristics of the secondary combustion air as it enters the furnace downstream of the exit throat.

In another aspect of the invention, the adverse pressure gradient boundary for a coal burner with a vortex flame stabilizer is intentionally modified by providing additional axial combustion air flow adjacent the fuel feed tube containing pulverized coal. This is obtained by incorporating an annular passageway for combustion air from the windbox to the furnace between the cyclone generator and the fuel feed tube. This passageway can provide sufficient additional axial flow to beneficially modify, in a downstream direction, the adverse pressure gradient boundary and enhance the amount of air near the fuel to more quickly achieve a desired flammability.

These and other advantages and objects of the invention can be understood from the following detailed description of an embodiment as described with reference to and shown in the drawings.

BACKGROUND OF THE INVENTION

DETAILED DESCRIPTION OF DRAWINGS

Figure 2:
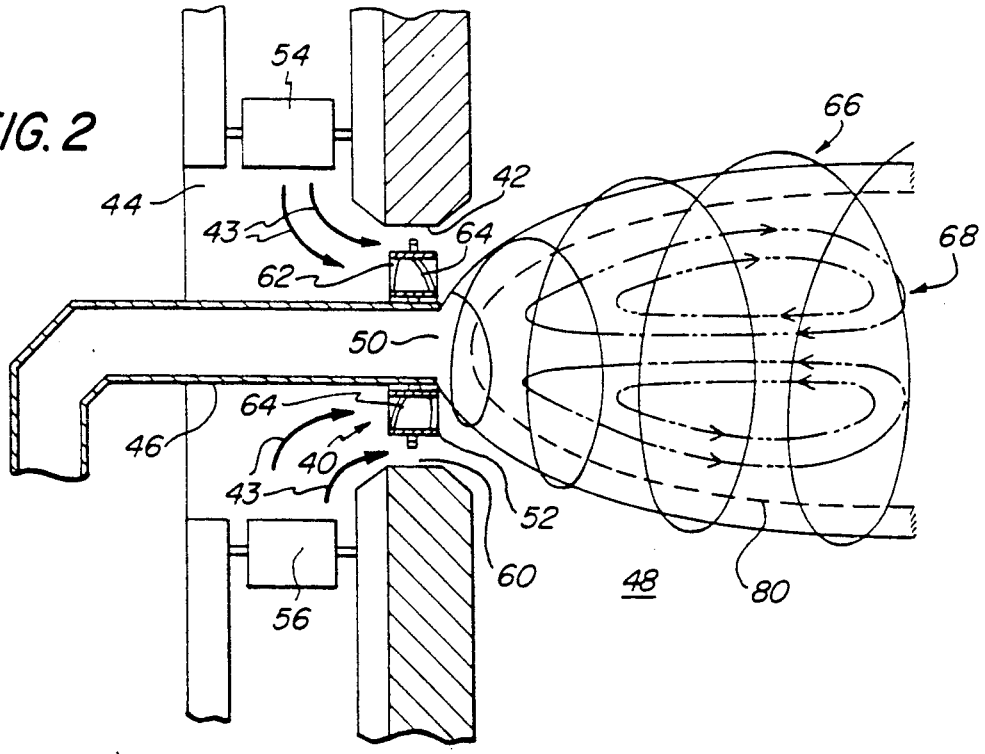
FIG. 2 is a similar schematic illustration as FIG. 1, but for a coal burner having a flame stabilizer in accordance with the invention.

With reference to FIG. 2, a solid fuel burner 40 is shown mounted in or near the exit throat 42 of a windbox 44 to burn pulverized fuel, such as sander wood dust or pulverized coal, delivered through a fuel feed conduit 46 to a furnace 48 at the discharge end 50 of fuel supply conduit 46. The conduit has a substantial diameter in order to deliver the desired amount of pulverized coal and primary air. The conduit has a diameter which is about 20% to 30% of the diameter of the exit throat 42. Coal burner 40 is provided with a flame stabilizer 52 that surrounds the fuel feed conduit 46 in the exit throat 42. Combustion air represented by arrows 43 is supplied to windbox 44 through controllable dampers 54, 56 to enter furnace 48, partly through the flame stabilizer 52 and partly through the annular gap 60 between the flame stabilizer 52 and exit burner throat 42.

Figure 1:
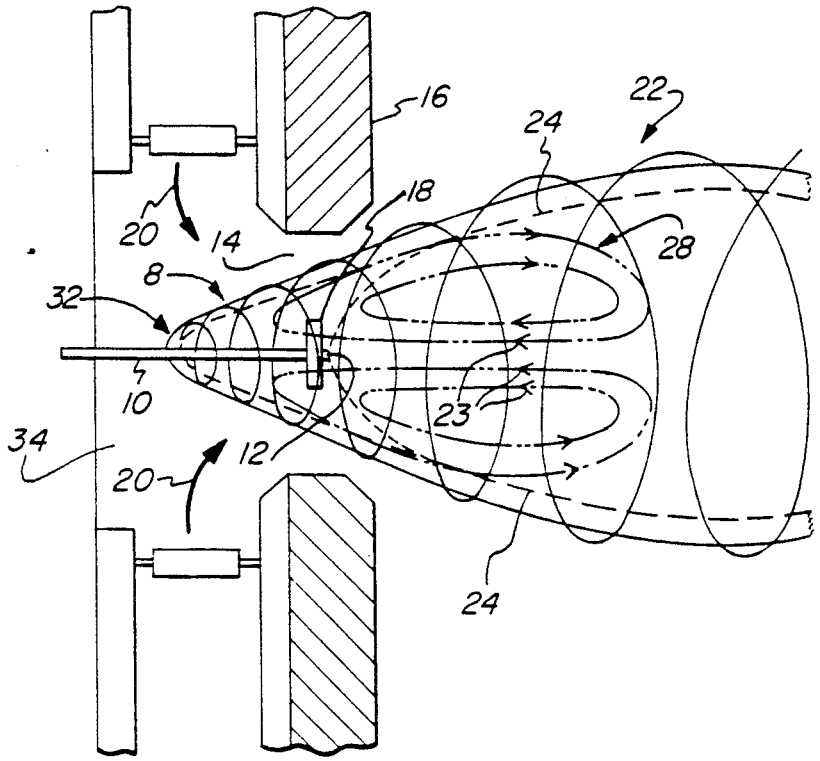
FIG. 1 is a schematic illustration of a conventional single zone burner encountering a burn-back problem.

The flame stabilizer 52 has a vortex generator 62 which is formed by a plurality of vanes 64. These have curved cross-sections in order to generate a vortex 66 with an internal recirculation pattern or ring 68 similar to 28 in FIG. 1. The flame stabilizer 52 is designed with a desired swirl number distribution and intercepts a portion of the secondary combustion air 43 to produce a swirl capable of stabilizing the flame in front, or downstream of the pulverized coal fuel discharge port 50 without thermal destruction of burner components.

Figure 4:
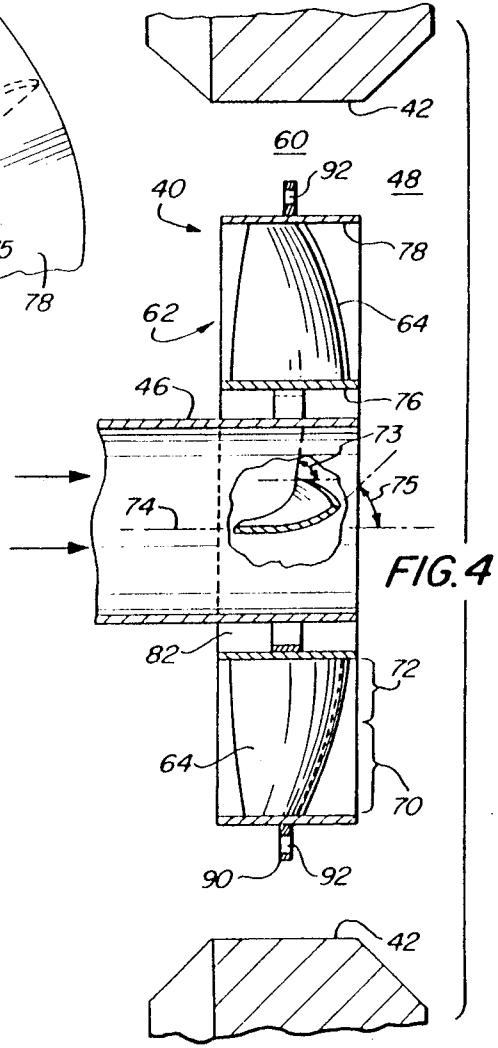
FIG. 4 is a side section and partially broken-away view as taken along the line 4—4 in FIG. 3 of the coal burner.
Figure 5:
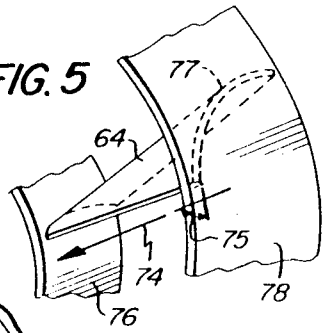
FIG. 5 is a partial perspective view of a single vane employed in a flame stabilizer in accordance with the invention.
Figure 3:
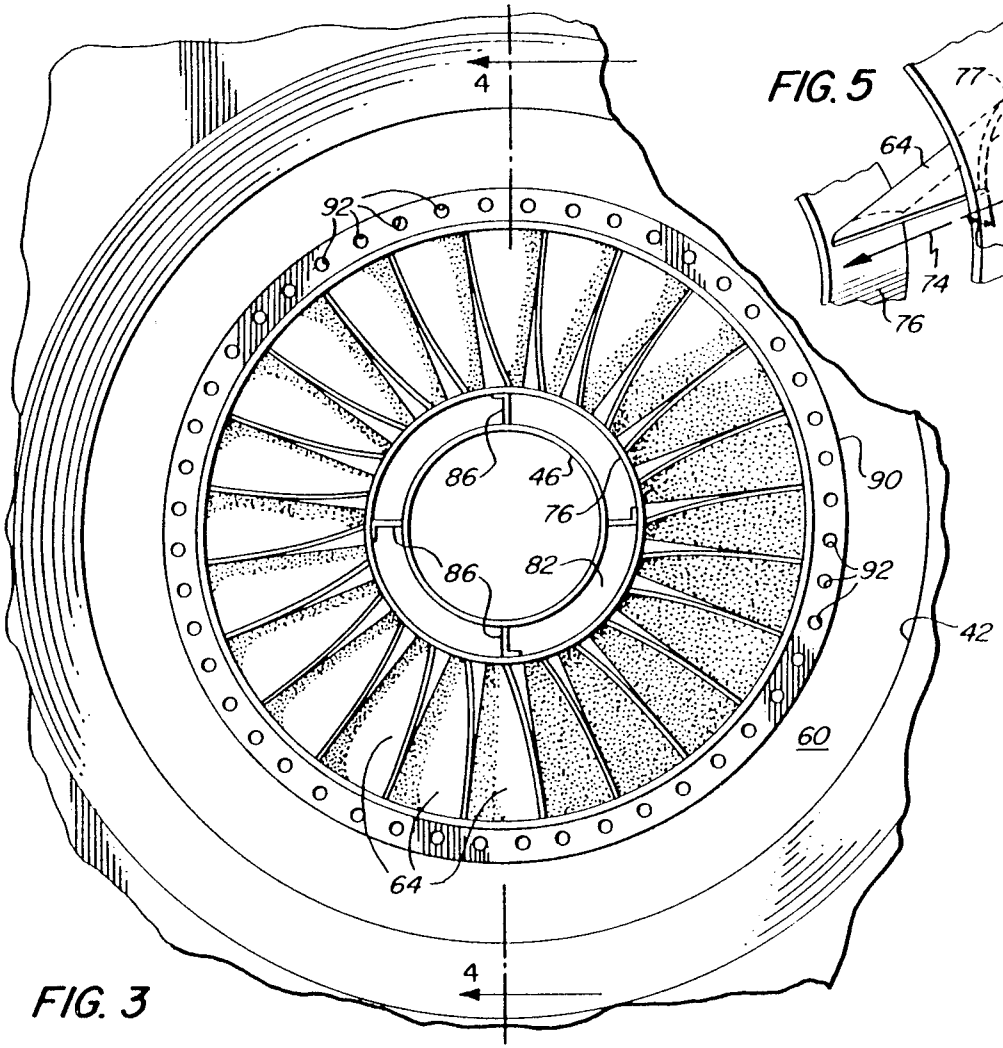
FIG. 3 is an upstream view of a coal burner and flame stabilizer in accordance with the invention taken from inside a furnace in which the burner is to operate.

This is achieved by shaping the swirl-inducing vanes 64 to produce a desired swirl number distribution whereby a higher swirl number, which can be as high as about 2.0, occurs in a radially peripheral region 70 (see FIGS. 4 and 5), and a lower swirl number, which can be as low as zero, at the root of the vanes 64, occurs in a radially inward region 72. This involves radially varying the curvature of the vanes so that the exit flow angles for the vanes varies, i.e., the exit flow angle of an axial segment of the vane relative to the longitudinal axis 74 of the burner, increases radially. For example, as illustrated in FIGS. 4 and 5, the exit flow angle 73 is smaller near the roots of the vanes where these are attached to the inner wall 76 of the vortex generator 62 than the exit flow angle 75 at their tips 77 adjacent the peripheral wall 78, with intermediate values in-between.

The swirl number varies across the flame stabilizer in a gradual manner. For illustrative purposes, the region 72 can be characterized by a relatively low swirl number, that can be somewhat less than 0.6 and the radially outer region 70 can be characterized by a higher swirl number, so that the integrated swirl number for all the high and low swirl regions is in the range from at least about 0.6 to about 2.0, and preferably in the range from about 0.8 to about 0.9. The vane curvatures and radial variations thereof are selected to achieve the desired swirl number. Since the application of a flame stabilizer in accordance with the invention may require different vanes and curvatures thereof, well known design techniques can be employed to obtain optimum vane designs.

The swirl effect for radially different regions in the vortex generator 62 will depend upon the characteristics of the particular burner on which the flame stabilizer is to be installed. One influencing factor is the integrated swirl number for the burner (usually about 0.3 for very volatile fuels such as natural gas to 1.5 for low volatile fuels such as high fixed carbon content coals). The integrated burner swirl number includes all high and low swirl zones in the burner such as the zone in front of the fuel discharge end 50 and the radially outward zone 60. Other factors influencing the desired amount of swirl include the most effective air injection desired to achieve low $NO_x$ levels, stoichiometric combustion requirements in the central flame region and the need to modify the adverse pressure gradient boundary to avoid burn-back problems.

It is generally recognized and known that the integrated swirl number for a burner should be in the range of about 0.3 for high volatile fuels to 1.5 for low volatile fuels. In practice even when this is achieved, burn-back problems can still occur. With a flame stabilizer of this invention, the adverse pressure gradient boundary, 80 (see FIG. 2) is intentionally distorted with more axially-directed mass flow near the center of the burner.

In the particular coal burner flame stabilizer 40 shown in FIGS. 4 and 5, this is achieved by the variable curvature of the cascaded vanes 64 by which axial flow is preferentially enhanced near the inward wall 76 and the use of an axial flow enabling annular air conduit or gap 82 around the fuel supply conduit 46. The air gap 82 provides more combustion air to the root of the fire thereby enabling the fuel to air ratio to more quickly attain the flammability range. The gap 82 also aids in lowering the swirl number sufficiently so as to distort the adverse pressure gradient boundary downstream of the discharge end 50 and in a downstream direction to avoid burn-back problems and flame pulsations.

The size of air gap 82 can vary depending upon the coal burner. Generally, the gap can be up to as much as several inches in width or no gap be used because sufficient axial air flow is obtained past the more axially-oriented vane regions 72. The effect of gap 82 and the swirl number variation is that the swirl does not extend down to the primary air and solid fuel flow located in the center of the burner. Yet, the flame is sufficiently stabilized to burn less volatile solid fuels.

The amount of combustion air intercepted by a flame stabilizer in accordance with the invention is controlled by sizing the radius of the perimeter wall 78. If the radius is too high, too much air is swirled and the integrated swirl number for the burner becomes too high, i.e., goes well above 1.0. Accordingly, the size of the flame stabilizer is selected so that it intercepts generally between about twenty percent (20%) to about forty percent (40%) of the secondary combustion air 43. Preferably, the size is such that about thirty percent (30%) of the combustion air is subjected to swirl inducement.

Within windbox 44 pressure fluctuations occur for a variety of reasons. These typically are small, of the order of a fraction of an inch water column, but often can lead to flame pulsations. A particularly effective aspect of the flame stabilizer shown in FIGS. 2 and 4 is the use of a pressure control ring 90 whereby the static pressure within the windbox 44 is raised above a minimum level needed to avoid such flame pulsations. The pressure control ring 90 effectively slightly narrows the gap through which combustion air 43 bypasses the flame stabilizer without increasing the swirl number. The pressure control ring 90 is apertured or perforated such as with holes 92, though slots could be used, in order to preserve the axial flow pattern of the combustion air. The increase in static pressure should be sufficient so that the differential pressure, i.e., the static pressure on the upstream side of the flame stabilizer 40 relative to its downstream side, is positive throughout the burner operations at various loadings. Generally, this means a static differential pressure of preferably greater than about two to about four inches of water column. The radial width of pressure control ring 90 is selected to radially extend the peripheral size of the flame stabilizer to establish the increased static pressure. Alternatively, the exit throat 42 of windbox 44 could be reduced by use of an insert to increase the static pressure.

Having thus described a solid fuel burner flame stabilizer in accordance with the invention, its advantages can be appreciated. Variations from the described embodiment can be made without departing from the scope of the invention as set forth by the following claims.

What is claimed is:

1. A flame stabilizer for a solid fuel burner which has a fuel feed conduit that terminates at a discharge end for use in or near the exit throat of a burner with combustion air being passed from a windbox around the fuel feed conduit, comprising:

a vortex generator having a periphery and being shaped to mount around the fuel feed conduit near its discharge end in the path of combustion air to generate a vortex downstream of the discharge end; said vortex generator having a plurality of air deflecting vanes shaped to radially vary their exit flow angles along their lengths generally from tips to roots of the vanes so as to emphasize axial flow in the vicinity of the fuel feed conduit and emphasize swirl inducement toward the periphery of the vortex generator; and with the radial size of the vortex generator being selected to intercept an amount of combustion air, so that the integrated swirl number for the flame stabilizer is in the range from about 0.6 to about 2.0.

2. The flame stabilizer in accordance with claim 1 wherein the integrated swirl number for the flame stabilizer is in the range from about 0.8 to about 0.9.

3. The flame stabilizer in accordance with claim 1 wherein the degree of swirl inducement from the vanes and the size of the flame stabilizer with respect to the exit throat of the solid fuel burner are selected such that the integrated swirl number for the burner, including high and low swirl zones of the burner and the discharge end of the fuel feed tube, is in the range from about 0.3 to about 1.5.

4. The flame stabilizer in accordance with claim 3 wherein the vanes have curved cross-sections.

5. The flame stabilizer in accordance with claim 1 wherein the radial size of the flame stabilizer is selected so as to intercept generally from about twenty percent (20%) to about forty percent (40%) of the combustion air passing through the exit throat of the windbox.

6. The flame stabilizer in accordance with claim 5 wherein the amount of intercepted combustion air is about thirty percent (30%) of the combustion air passing through the exit throat of the burner.

7. The flame stabilizer in accordance with claim 1 and further including:

pressure control means for increasing the static pressure of combustion air upstream of the flame stabilizer so as to establish a positive gas pressure differential with which the upstream side of the stabilizer is greater than gas pressure its downstream side throughout the operation of the flame stabilizer, said pressure differential being sufficiently low so as to preserve swirling action by the flame stabilizer and sufficiently high to inhibit a burn-back condition in the burner.

8. The flame stabilizer in accordance with claim 7 wherein the pressure control means radially extends the periphery of the flame stabilizer so as to produce a said positive pressure differential in the range from about a half inch (0.5") of water to about four inches (4") of water column.

9. The flame stabilizer in accordance with claim 7 wherein the pressure control means is an apertured pressure control ring affixed to the flame stabilizer.

10. The flame stabilizer in accordance with claim 1 wherein during operation of the solid fuel burner an adverse pressure gradient boundary is established around the vortex generated by the vortex generator, and further including means surrounding the fuel feed conduit to provide an axial passageway around for combustion air the fuel feed conduit to enhance axial combustion air flow through said discharge end for a favorable modification of the adverse pressure radiant boundary with a reduction of the swirl number, across the discharge end and across said means for providing said enhanced axial combustion air flow, thereacross to substantially less than 0.6.

11. The flame stabilizer as claimed in claim 10 wherein said axial passageway producing means comprises an inner conduit mounted to surround and having a larger cross-section than the fuel feed conduit.

12. A flame stabilizer for a coal burner which has a fuel supply conduit that terminates at a discharge end for use in or near the exit throat of a burner through which combustion air is passed from a windbox, comprising:

a vortex generator having a periphery and being shaped to mount around the supply conduit near its discharge end and in the path of combustion air to generate a vortex downstream of the discharge end of the supply conduit;

said vortex generator having means for inducing swirl of combustion air downstream of the discharge end with significantly greater swirl inducement towards the periphery and significantly less swirl inducement towards the fuel supply conduit;

the size of the vortex generator being selected so as to intercept between about 20% to about 40% of the combustion air so as to establish an integrated swirl number for the flame stabilizer in the range from about 0.6 to about 2.0.

13. The flame stabilizer as claimed in claim 12 wherein said swirl inducing means includes:

means for generating an axially directed flow of combustion air around the fuel supply conduit to distort the position of a portion of an adverse pressure gradient boundary in a downstream direction.

14. The flame stabilizer as claimed in claim 13 and further including:

means affixed to the periphery of the flame stabilizer for increasing the static pressure in the windbox to a level sufficient to reduce flame pulsations attributable o low windbox static pressure while retaining said induced swirl.

15. The flame stabilizer as claimed in claim 14 wherein said static pressure increasing means establishes a windbox static pressure in the range from about 0.5 inches to about 4.0 inches of water column.

16. The flame stabilizer as claimed in claim 15 wherein the means for inducing said swirl produces an integrated swirl number for the flame stabilizer in the range from about 0.8 to about 0.9.

17. A method for stabilizing the flame of a solid fuel burner to which a solid fuel is delivered in a downstream direction through a conduit and combustion air is delivered in a downstream direction outside of the conduit for combustion of the solid fuel downstream of a discharge end of the conduit, comprising the steps of:

inducing a swirl of a portion of the combustion air so as to form a vortex of gases downstream of the solid fuel burner, the portion of the combustion air being swirled being selected so that the swirl number varies radially with respect to the conduit, with more axial combustion air flow near the conduit and more swirl radially away from the conduit, and with about 20% to about 40% of the combustion air being subjected to swirl inducement; and obstructing the flow of the combustion air near the discharge end to increase the static pressure of the combustion air upstream of the discharge end to a level sufficient to avoid flame pulsations attributable to low upstream static pressure while being sufficiently low to preserve the vortex.

18. The method as claimed in claim 17 wherein the vortex is characterized by an adverse pressure gradient boundary, and further including the step of:

enhancing an axial flow of the combustion air in a region around the discharge end to distort the position of the adverse pressure gradient boundary near the discharge end towards a downstream direction.

19. The method as claimed in claim 18 wherein the combustion air being swirled establishes an integrated swirl number on the downstream side of the discharged end in the range from about 0.3 for volatile fuels to about 1.5 for low volatile fuels.

20. The method as claimed in claim 17 wherein the combustion air being swirled establishes an integrated swirl number for flame stabilization in the range from about 0.6 to about 2.0.

* * * * *